US008182565B2

(12) United States Patent
Nomura

(10) Patent No.: US 8,182,565 B2
(45) Date of Patent: May 22, 2012

(54) COMPRESSOR INCORPORATED WITH OIL SEPARATOR

(75) Inventor: Tatsuki Nomura, Maebashi (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 474 days.

(21) Appl. No.: 12/526,178

(22) PCT Filed: Jan. 31, 2008

(86) PCT No.: PCT/JP2008/051480

§ 371 (c)(1),
(2), (4) Date: Aug. 6, 2009

(87) PCT Pub. No.: WO2008/096654

PCT Pub. Date: Aug. 14, 2008

(65) Prior Publication Data

US 2010/0307343 A1 Dec. 9, 2010

(30) Foreign Application Priority Data

Feb. 6, 2007 (JP) ..... 2007-027080

(51) Int. Cl.
*B01D 50/00* (2006.01)

(52) U.S. Cl. ..... 55/385.1; 55/431; 55/385.3; 55/394; 55/396; 55/423; 55/459.1; 55/406; 55/407; 55/408; 96/216; 418/55.1; 418/55.6; 418/57; 418/97; 418/270; 418/DIG. 1

(58) Field of Classification Search ..... 55/385.1, 55/385.3, 394, 396, 423, 459.1, 406–408; 418/55.1–55.6, 57, 97, 270, DIG. 1; 96/216
See application file for complete search history.

(56) References Cited

U.S. PATENT DOCUMENTS

2009/0246061 A1* 10/2009 Iijima et al. ..... 418/97
2009/0304539 A1* 12/2009 Kii et al. ..... 418/55.6
2011/0014077 A1* 1/2011 Martens ..... 418/84
2011/0146215 A1* 6/2011 Lee et al. ..... 55/456

FOREIGN PATENT DOCUMENTS

JP 2003201964 A * 7/2003
JP 2003336588 A * 11/2003
JP 2005083234 A * 3/2005
JP 2006105064 A * 4/2006
JP 2006132487 A * 5/2006
JP 2006249992 A * 9/2006

* cited by examiner

*Primary Examiner* — Jason M Greene
*Assistant Examiner* — Dung H Bui
(74) *Attorney, Agent, or Firm* — Baker Botts L.L.P.

(57) ABSTRACT

A compressor incorporated with an oil separator having a separation chamber and communication holes. The separation chamber is placed adjacent to a discharge chamber, has a space formed in the entire inside of the separation chamber, separates oil-containing gas, which is introduced into the separation chamber, into gas and oil by centrifugal separation, allows the separated oil to drop downward, and upwardly extracts the separated gas. The communication holes interconnect the discharge chamber and the separation chamber and introduce the oil-containing gas, coming from the discharge chamber, into the separation chamber. The communication holes are arranged in the separation chamber, in a direction extending from a gas release side to an oil drop side. The structure of an oil separation section is simplified to improve productivity and reduce cost, and a high degree of design freedom of the position of a discharge port is obtained.

11 Claims, 5 Drawing Sheets

COMPRESSOR INCORPORATED WITH OIL SEPARATOR

CROSS-REFERENCE TO RELATED APPLICATIONS

This application is the National Stage of International Patent Application No. PCT/JP2008/051480, filed Jan. 31, 2008, which claims the benefit of Japanese Patent Application No. 2007-027080, filed Feb. 6, 2007, the disclosures of which are incorporated herein by reference in their entirety.

TECHNICAL FIELD OF THE INVENTION

The present invention relates to a compressor incorporated with an oil separator, and specifically, to a compressor incorporated with an oil separator in which simplification of oil separator incorporation mechanism, decrease of number of parts, facilitation of assembly, cost down, etc. are attempted.

BACKGROUND ART OF THE INVENTION

As a compressor assembled in, for example, a refrigeration system of an air conditioning system for vehicles, a compressor incorporated with an oil separator, in which a centrifugal separation system oil separator is incorporated into a compressor, has been known (for example, Patent document 1). In a conventional compressor incorporated with an oil separator, for example, as is shown in FIG. 10 an example of a case of a scroll-type compressor which has a compression mechanism 103 comprising a fixed scroll 101 and a movable scroll 102, a centrifugal separation system oil separator 107 is incorporated into a rear casing 106 forming a discharge chamber 105 into which the gas (for example, refrigerant gas) compressed in compression mechanism 103 is introduced through a discharge hole 104. In such an oil separator 107, a structure is employed wherein a cylindrical cylinder (oil separation chamber 108) is provided in casing 106 as an oil separation section, on the axis thereof a separation pipe 109 is inserted or press fitted, and the upper end side thereof is fixed by or engaged with a snap ring 110. Because the oil separation section is provided only in casing 106 and the oil separation section is formed by machining, a seal bolt 111 is required in order to keep the inside pressure. Further, a discharge port 112 connected to outside of the compressor (external tube) is communicated with a space formed between the upper end of separation pipe 109 and the lower end of seal bolt 111.

The gas compressed in compression mechanism 103 is discharged into discharge chamber 105 through discharge hole 104 of the fixed scroll, and the oil-containing gas in discharge chamber 105 is introduced into oil separation chamber 108 through communication holes 113. The introduced gas rotates around separation pipe 109, and separated into gas and oil utilizing centrifugal force. The separated gas passes through the inside of separation pipe 109 and is discharged from discharge port 112, and the oil separated by centrifugal force is stored in a lower oil-storing chamber 115 through a lower hole 114. The oil stored in oil-storing chamber 115 is returned to a suction chamber 117 through an orifice 116.

Patent document 1: JP-A-11-93880

DISCLOSURE OF THE INVENTION

Problems to be solved by the Invention

There are the following problems in the above-described structure of the conventional oil separator.

Since it is necessary to form all of oil separation chamber 108 (cylinder portion), lower hole 114, the insertion or press fitting portion of separation pipe 109 and the screw portion of seal bolt 111 by machining and there are many machining portions, the productivity is bad and the cost is high.

Further, because parts such as separation pipe 109 and seal bolt 111 are required and the overall length of oil separation chamber 108 becomes relatively long, the workability of this portion is bad. Further, because the shape of oil separation chamber 108 (cylinder portion) is cylindrical, there is a restriction in space for providing the oil separation section, and the overall length of the casing becomes long. Therefore, the productivity is bad and the design freedom is small.

Further, because parts such as separation pipe 109, snap ring 110 and seal bolt 111 are required and the number of parts is great, the time for assembly is long. Further, in the process for press fitting of separation pipe 109 and the process for fastening of seal bolt 111, a defect is likely to occur. Therefore, there are problems that the productivity is bad and costs are high for both of manufacture and assembly.

Moreover, although the compressed gas after oil separation is discharged to outside of the compressor from discharge port 112 communicated with the space formed between the lower end of seal bolt 111 and the upper end of separation pipe 109, because there is no freedom in layout of the separation mechanism portion, the position of discharge port 112 is also restricted. Therefore, there are problems that the freedom in position of discharge port 112 is small and there are restrictions in design of compressor itself and in connection structure to outside.

Accordingly, paying attention to the above-described problems, an object of the present invention is to provide a compressor incorporated with an oil separator which can achieve improvement of productivity and cost down and ensure design freedom in position of discharge port.

Means for Solving the Problems

To achieve the above-described object, a compressor incorporated with an oil separator according to the present invention has a separation chamber, which is placed adjacent to a discharge chamber, has a space formed in the entire inside of the separation chamber, separates oil-containing gas being introduced into gas and oil by centrifugal separation, allows the separated oil to drop downward, and upwardly extracts the separated gas, and having communication holes provided between the discharge chamber and the separation chamber, which introduce the oil-containing gas, coming from the discharge chamber, into the separation chamber, wherein a plurality of the communication holes are arranged in a direction extending from a gas release side to an oil drop side, relative to the separation chamber.

In such a structure, since a communication hole positioned at most gas release side among the plurality of communication holes is formed so as to be able to give a flow of oil-containing gas introduced from the most gas release-side communication hole into the separation chamber an air curtain function relative to a flow of oil-containing gas introduced from the other communication hole or communication holes into the separation chamber toward the gas release side, the oil-containing gas introduced from the other communication hole or communication holes into the separation chamber efficiently swirls along the inner wall of the separation chamber without being pulled to the gas release side, and flows toward the oil-storing chamber side while being separated into oil and gas. Therefore, the structure can exhibit a separation performance equal to or more than that in the conventional oil separator having a separation pipe in a separation chamber as shown in FIG. 10.

The above-described oil separator can be formed by a joining structure of two compressor forming members.

Namely, since the cylinder portion of the oil separation mechanism (separation chamber), the portions of the communication holes and the portion of the lower hole are formed by the combination structure of the two compressor forming members, it becomes possible to form these portions without applying machining, and therefore, the productivity may be greatly improved, and cost down becomes possible. Further, because the separation pipe in the conventional structure can be abolished and the mechanism for securing or engagement mechanism thereof, further, the seal bolt, can be abolished, the structure of the entire separation mechanism can be simplified and the number of parts can be greatly decreased, and therefore, shortening of assembly time, facilitation of assembly and cost down may be achieved. Further, as the result of abolishment of the seal bolt, etc., it becomes possible to shorten the overall length of the oil separation section and make the section small, and to make the whole of the compressor small.

Further, in the present invention, a structure may be employed wherein a passageway for gas having passed through the separation chamber is provided between the separation chamber of the oil separator and a discharge port connected to outside of the compressor, and the gas passageway is also formed by the joining structure of the two members. The discharge port may be communicated with this gas passageway, thereby flowing out gas separated from oil from the discharge port to outside.

In this compressor incorporated with an oil separator according to the present invention, although the oil separator is formed basically as a centrifugal system oil separator, because the number of parts is small and there is no machining portion, the freedom in shape of the above-described separation chamber is maintained to be remarkably high. Therefore, the separation chamber can be formed in a cylindrical shape whose generating line extends straightly similarly in the conventional shape, and can also be formed in a cylindrical shape whose generating line extends curvedly (a separation chamber formed as a whole in a doughnut shape (a shape forming a part of a doughnut shape)). In particular, by forming the separation chamber in a cylindrical shape with a curvature (a doughnut shape), the freedom in layout greatly increases, and the whole of the compressor may be formed compact.

Further, with respect to the cross-sectional shape in the above-described cylindrical shape, although a substantially complete circle is preferable, for forming the joining structure of the two members, a structure may be employed wherein a small difference in level on the inner surface of the cylindrical shape occurs, or a structure may be employed wherein a difference in curvature between arcs in the cross-sections of the cylindrical shapes of the two members forming the inner surface of the cylindrical shape occurs. Further, when the inner surface of the cylindrical shape is formed, a difference in circumferential length of inner surface may occur between the two members. Furthermore, a difference may occur between the depths of arc-like grooves in the cross section of the cylindrical shape, formed by the two members forming the inner surface of the cylindrical shape.

Further, although decrease of the oil separation ability can be avoided by giving the above-described air curtain function to the flow oil-containing gas introduced from the communication hole positioned at most gas release side into the separation chamber, in order to further avoid decrease of the oil separation ability ascribed to abolishment of separation pipe surely, it is preferred to change the blow directions of the compressed gasses blown from the plurality of communication holes into the oil separation chamber. For example, by employing a structure wherein the opening direction or opening directions to the separation chamber of the other communication hole or communication holes is or are directed to more oil-storing chamber side as compared with the opening direction of the communication hole positioned at most gas release side, while pulling the oil-containing gas being introduced into the separation chamber toward the gas release side can be suppressed, the centrifugal force for the separation can be effectively applied to oil, and therefore, it becomes possible to efficiently separate oil toward the oil-storing chamber side. Further, if a structure is employed wherein the opening direction to the separation chamber of each of the plurality of communication holes is changed, the angle of the direction of the gas blown into the oil separation chamber is changed for each communication hole, gas blow in accordance with the shape of the oil separation chamber, etc. becomes possible, an efficient separation becomes possible, and it becomes possible to efficiently introduce the separated oil into the oil-storing chamber.

Further, a structure may also be employed wherein a stepped portion or a dam portion is provided in the above-described gas passageway. Thus, by devising the shape of the gas passageway between the separation chamber and the discharge port, flowing out of oil from the discharge port can be decreased.

Although such a structure incorporated with an oil separator according to the present invention can be applied to substantially any type compressor, especially it is suitable to a scroll-type compressor. In case of scroll-type compressor, for example, a structure can be employed wherein one of the two members is a fixed scroll forming member, and the other of the two members is a compressor casing.

Effect According to the Invention

Thus, in the compressor incorporated with an oil separator according to the present invention, since an oil separator can be formed by joining structure of two members (for example, a fixed scroll forming member and a casing) without machining a cylinder, communication holes, a separation pipe holding portion, a lower hole, etc. in a conventional structure, and an excellent oil separation ability can be exhibited even by a structure abolishing a separation pipe, the following effects can be obtained.

(1) The productivity can be improved and cost down can be achieved on working by abolishment of machining of an oil separation section.

(2) Cost down at a single part can be achieved and the assembling ability can be improved by decrease of the number of parts.

(3) The assembling process can be greatly simplified, the processes for press fitting of a separation pipe and fastening of a seal bolt, which have been necks in a conventional technology, are abolished, defects in such conventional processes do not occur, and the fraction defective in the assembling process can be greatly decreased.

(4) The freedom in position of discharge port can be greatly increased, and by that, the layout property for a discharge port, ultimately, the layout property as the whole of the compressor incorporated into a system, can be greatly improved.

EXPLANATION OF SYMBOLS

Figure 1:
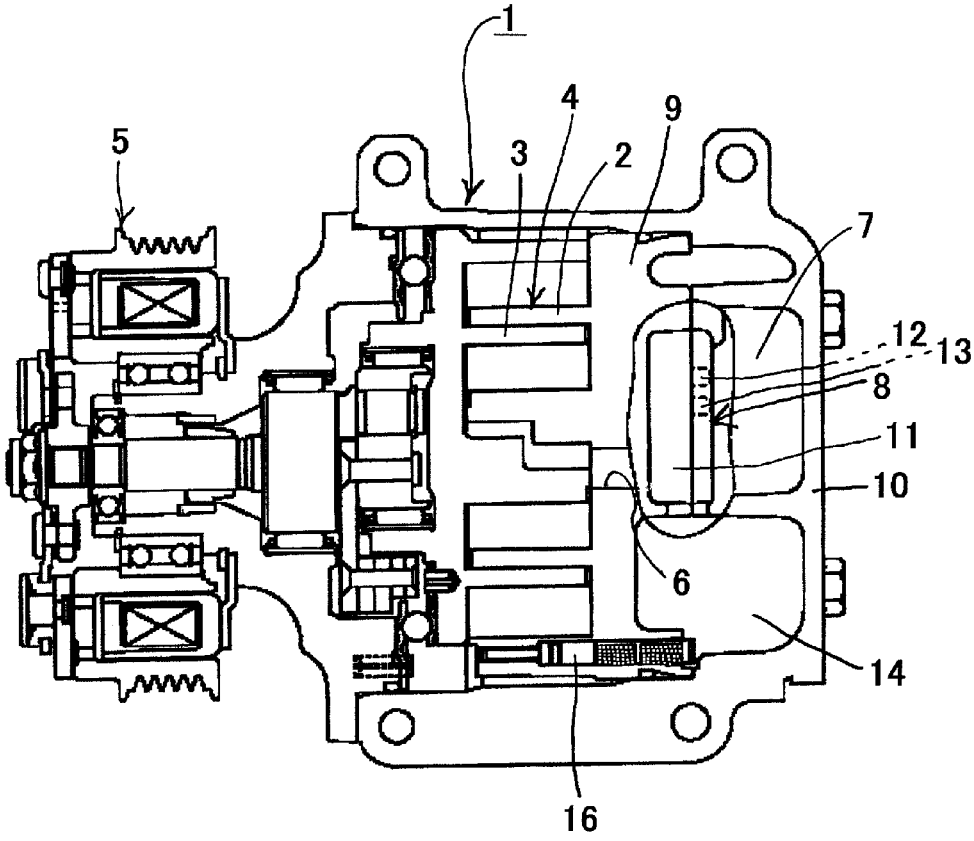
FIG. 1 is a vertical sectional view of a compressor incorporated with an oil separator according to a first embodiment of the present invention.

1: compressor incorporated with an oil separator
2: fixed scroll
3: movable scroll
4: compression mechanism
5: clutch mechanism
6: discharge hole
7, 20: discharge chamber
8: oil separator
9: fixed scroll forming member
10: casing
11, 21: separation chamber
12, 13, 22, 23, 24: communication hole
14: oil storing chamber
15: lower hole
16: orifice
17: passageway for gas having passed through separation chamber
18: discharge port
19: stepped portion (or dam portion)

THE BEST MODE FOR CARRYING OUT THE INVENTION

Hereinafter, desirable embodiments of a compressor incorporated with an oil separator according to the present invention will be explained referring to figures.

FIG. 1 depicts a compressor incorporated with an oil separator according to a first embodiment of the present invention. As a compressor incorporated with an oil separator 1, a case of a scroll-type compressor having a compression mechanism 4 comprising a fixed scroll 2 and a movable scroll 3 is exemplified.

Compressor incorporated with an oil separator 1 has a clutch mechanism 5, and by on/off operation of clutch mechanism 5, power from an external drive source (for example, an engine, a motor, etc. as a vehicle prime mover) is transmitted to and interrupted from movable scroll 3. When the power is transmitted to movable scroll 3, the movable scroll 3 operates at an orbital movement around fixed scroll 2, the gas (for example, refrigerant gas) compressed in compression mechanism 4 is introduced into a discharge chamber 7 through a discharge hole 6.

Figure 4:
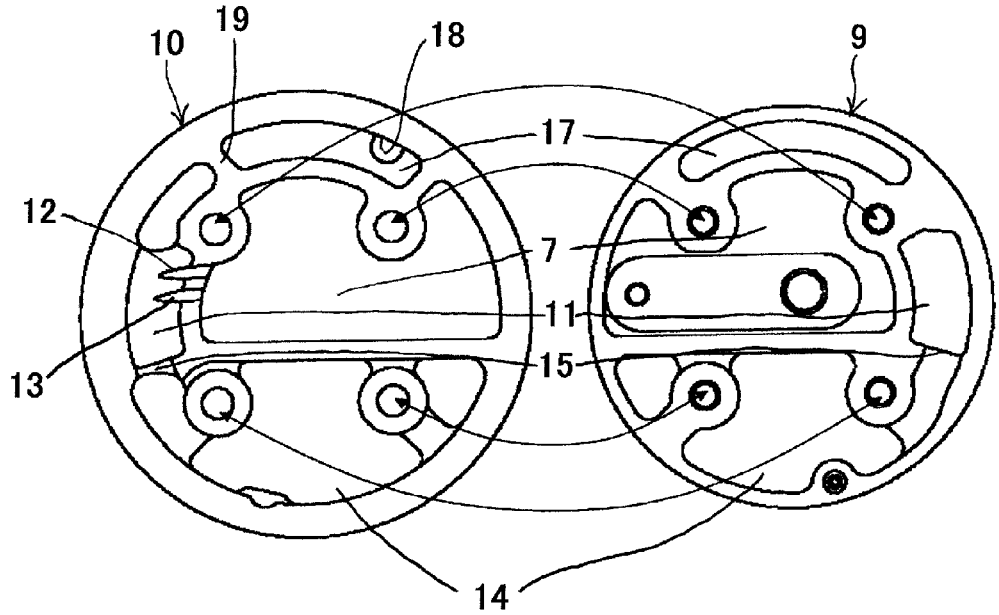
FIG. 4 is an exploded elevational view showing a combination of a fixed scroll forming member and a casing which form an oil separator of the compressor depicted in FIG. 1.
Figure 5:
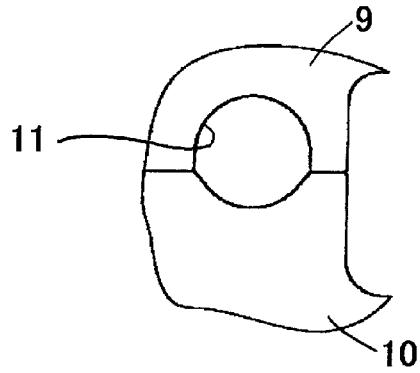
FIG. 5 is a partial sectional view of an upper end of an oil separator of the compressor depicted in FIG. 1.
Figure 6:
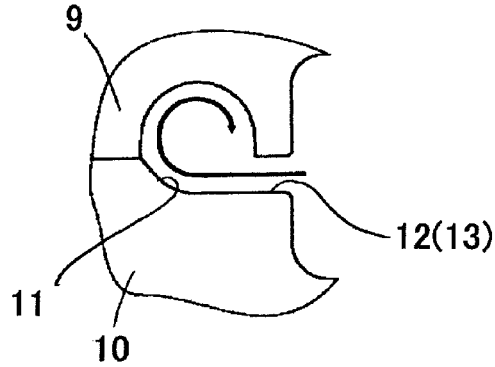
FIG. 6 is a partial sectional view of a portion provided with communication holes in an oil separator of the compressor depicted in FIG. 1.
Figure 8:
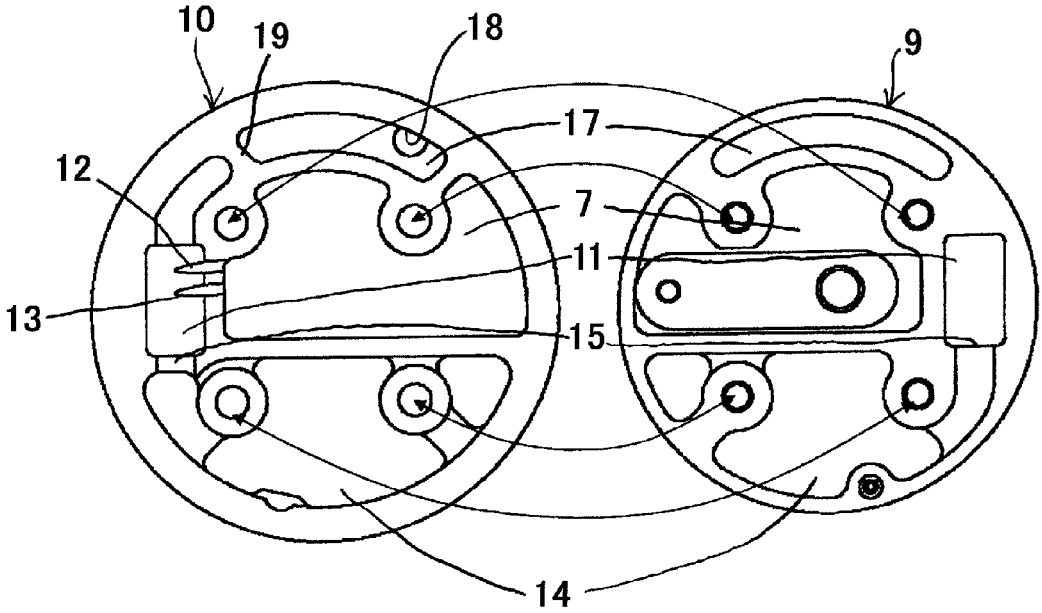
FIG. 8 is an exploded elevational view showing a combination of a fixed scroll forming member and a casing which form an oil separator for a compressor according to an embodiment different from the compressor depicted in FIG. 1.

An oil separator 8 is incorporated at an appropriate position around discharge chamber 7. As shown in FIGS. 4-6, this oil separator 8 is formed by a joining structure of two members of a fixed scroll forming member 9 and a compressor casing 10. Oil separator 8 has a separation chamber 11 with a cylinder structure, which separates oil from gas by centrifugal force and the whole of which is formed as a space. In this embodiment, separation chamber 11 is formed in a cylindrical shape whose generating line extends curvedly (a cylindrical shape forming a part of a doughnut shape). Alternatively, it is possible to form separation chamber 11 as a cylindrical shape whose generating line extends straightly as depicted in FIG. 8.

Figure 3:
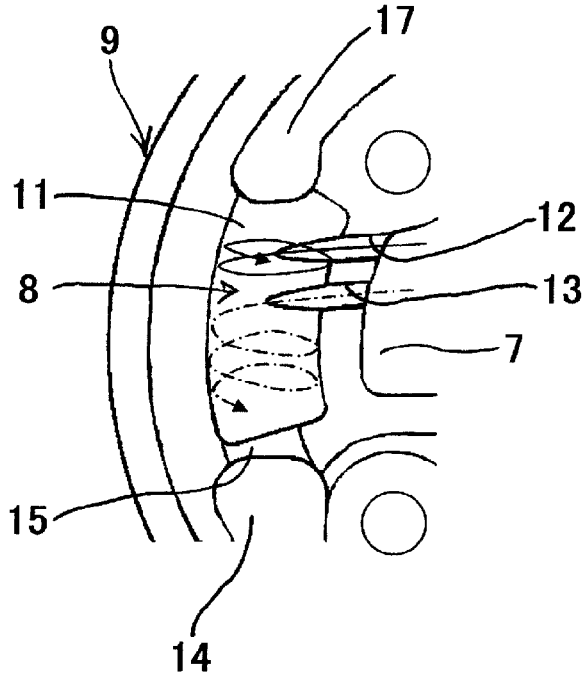
FIG. 3 is an enlarged, partial sectional view of an oil separator section of FIG. 1.
Figure 7:
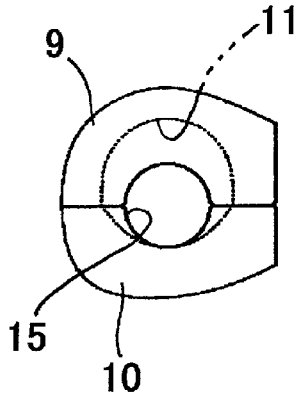
FIG. 7 is a partial sectional view of a lower hole portion on a lower end of an oil separator of the compressor depicted in FIG. 1.

Separation chamber 11 and discharge chamber 7 are disposed adjacent to each other, and between separation chamber 11 and discharge chamber 7, a plurality of communication holes 12, 13 are provided for introducing oil-containing gas from discharge chamber 7 into separation chamber 11. In this embodiment, two communication holes 12, 13 are arranged in a direction extending from an upper gas release side to a lower oil drop side. As depicted in FIG. 6, the oil-containing gas (shown by an arrow) is introduced from communication holes 12, 13 into separation chamber 11 at a position eccentric from the center axis of the cylindrical shape of separation chamber 11, a flow is formed along the inner surface of separation chamber 11, and oil in gas is separated by centrifugal force. Although the opening directions of communication holes 12, 13 are set in the same direction in this embodiment, as depicted in FIG. 3, it is possible to set so that the opening directions to separation chamber 11 are different from each other between communication hole 12 positioned at most gas release side and communication hole 13 positioned at oil drop side. In FIG. 3, it is set in angle that the opening direction of communication hole 13 is directed to more oil-storing chamber 14 side. The separated oil is stored in oil-storing chamber 14 through a lower hole 15 provided at a lower end of separation chamber 11. Where, in this embodiment, although lower hole 15 is formed at a position eccentric from the center of the cylindrical shape of separation chamber 11 as depicted in FIG. 7, it is not limited thereto, lower hole 15 may be provided so that the center of lower hole 15 coincides in position with the center of the cylindrical shape of separation chamber 11. The oil stored in oil-storing chamber 14 is returned to the suction chamber side through an orifice 16.

In this embodiment, oil-containing gas introduced from communication hole 12 positioned at most gas release side into separation chamber 11 rotates along the inner wall of separation chamber 11, and does not immediately flow into the oil drop side (oil-storing chamber 14 side). Therefore, the gas flow thereof exhibits an air curtain function against the flow toward the gas release side of oil-containing gas introduced from communication hole 13 positioned at oil drop side into separation chamber 11. In other words, communication hole 12 positioned at most gas release side is formed as a communication hole capable of giving a flow of oil-containing gas introduced from communication hole 12 into separation chamber 11 an air curtain function relative to a flow of oil-containing gas introduced from communication hole 13 into separation chamber 11 directed toward the gas release side.

Figure 2:
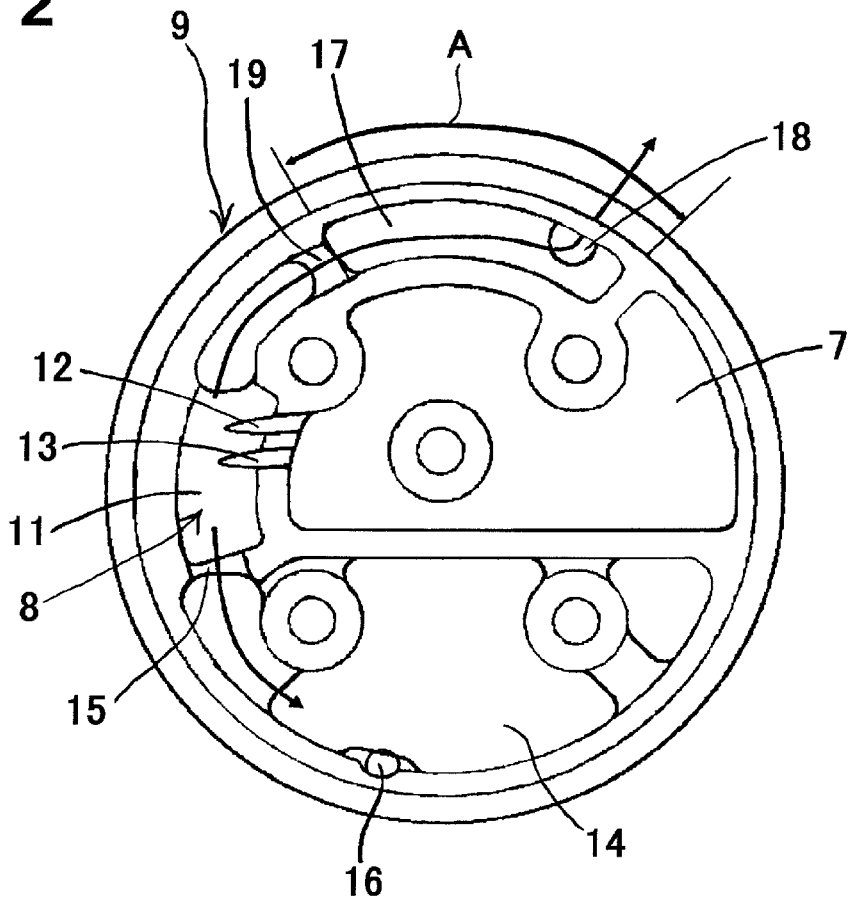
FIG. 2 is a cross-sectional view of a portion including a discharge chamber in the compressor depicted in FIG. 1.

The gas separated in separation chamber 11 is discharged from a discharge port 18 to outside of the compressor through a passageway 17 for gas having passed the separation chamber which is communicated with the upper end of separation chamber 11. In this embodiment, as depicted in FIG. 2, a stepped portion 19 (or a dam portion) is provided in gas passageway 17, and by the presence of stepped portion 19, the flow in gas passageway 17 is curved, thereby suppressing the oil from flowing out from discharge port 18 toward outside. Where, discharge port 18 can be provided within a range A shown in FIG. 2, and it may be provided at any position as long as within the range A.

In compressor incorporated with an oil separator 1 formed as a scroll-type compressor which is constructed as described above, a plurality of communication holes are formed by communication holes 12, 13 arranged in a direction extending from the gas release side to the oil drop side, relative to separation chamber 11, and communication hole 12 positioned at most gas release side is formed so as to be able to give the flow of oil-containing gas introduced from communication hole 12 into separation chamber 11 an air curtain function relative to a flow of oil-containing gas introduced from communication hole 13 into separation chamber 11 directed toward the gas release side. Therefore, since the oil-containing gas introduced from communication hole 13 into separation chamber 11 rotates efficiently along the inner wall of separation chamber 11 without being pulled toward the gas release side and separated into oil and gas, the oil separator can exhibit a separation ability equal to or higher than that in a conventional oil separator having a separation pipe.

Further, in compressor incorporated with an oil separator 1 formed as described above, particularly by forming separation chamber 11, lower hole 15 and communication holes 12, 13 by the joining structure of fixed scroll forming member 9 and casing 10, they can be easily formed only by merely assembling fixed scroll forming member 9 and casing 10. Namely, because fixed scroll forming member 9 and casing 10 forming the oil separator forming portion can be made by casting, the machining process for the cylinder portion, etc. in the conventional structure is not required at all. Further, the separation pipe, the seal bolt, etc. in the conventional structure become unnecessary, and the number of parts is greatly decreased. Consequently, the assembly is facilitated, the time for assembly is shortened, defects in assembly are greatly decreased, and a great increase in productivity and a cost down become possible.

Further, as the shape of separation chamber 11, although any of a cylindrical shape whose generating line extends straightly, similar to a conventional shape, and a cylindrical shape formed as a doughnut shape with a curvature as in this embodiment, can be employed, by employing the cylindrical shape formed as a doughnut shape as in this embodiment, the freedoms of disposition and shape of separation chamber 11 increase, and the freedom in layout thereof greatly increases and such a shape can contribute to make the whole of compressor 1 compact. As to the cross-sectional shape of the cylindrical shape, as aforementioned, as needed, it is not necessary to be a complete circle, and further, a difference on formation of a circle as the cross-sectional shape may be present between two members.

Furthermore, by providing stepped portion 19 in passageway 17 for gas having passed through oil separation chamber 11, it becomes possible to greatly decrease the amount of oil flowing out from discharge port 18 to external circuit side.

Figure 9:
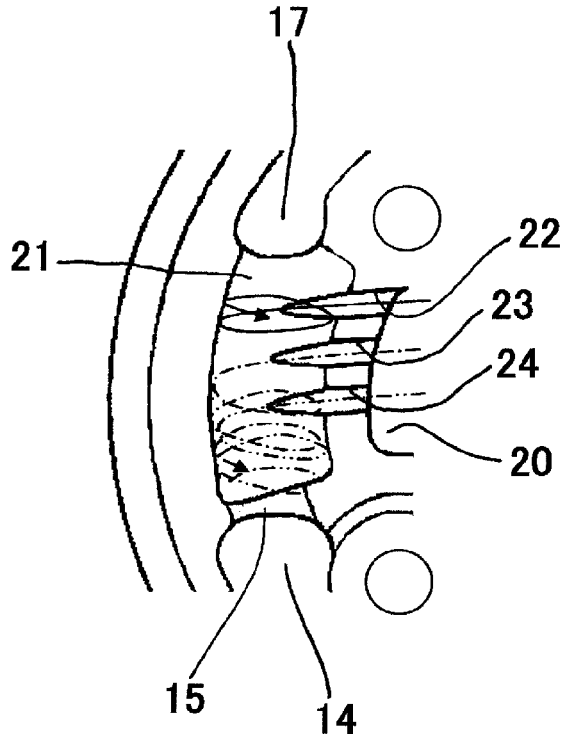
FIG. 9 is a partial sectional view of an oil separation section of a compressor incorporated with an oil separator according to a second embodiment of the present invention.
Figure 10:
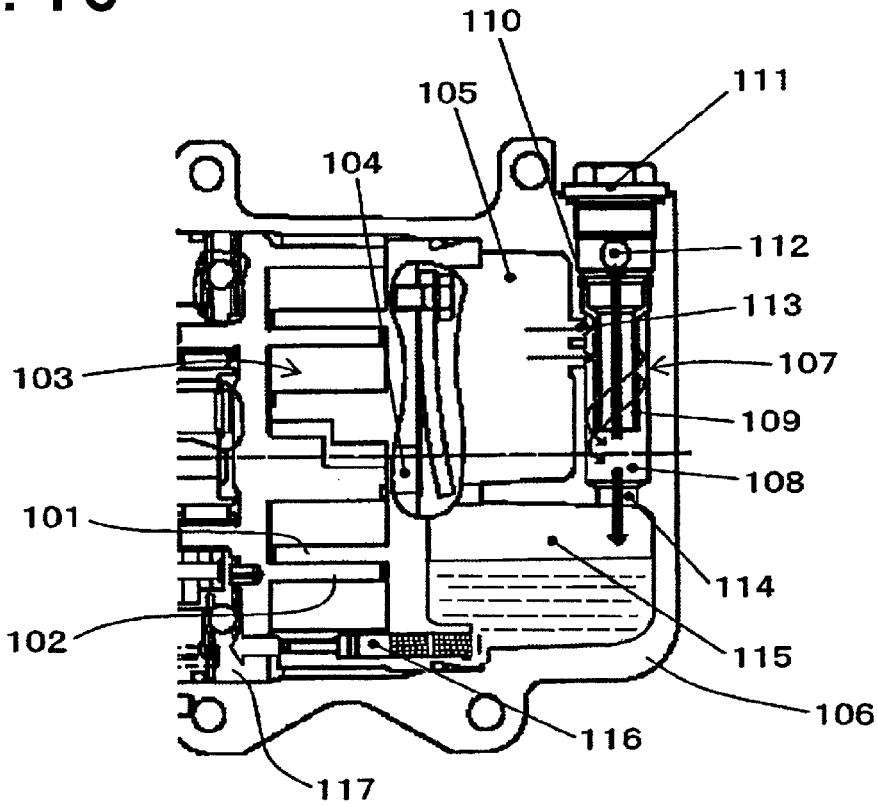
FIG. 10 is a vertical sectional view of a conventional compressor incorporated with an oil separator.

FIG. 9 depicts an oil separation section of a compressor incorporated with an oil separator according to a second embodiment of the present invention. In this embodiment, the communication holes communicating between separation chamber 21 and discharge chamber 20 are formed from three communication holes 22, 23 and 24. In FIG. 9, the flow of oil-containing gas introduced from communication hole 22 into separation chamber 21 is indicated by a solid line, and the flows of oil-containing gas introduced from communication holes 23, 24 into separation chamber 21 are indicated by one-dot chain line and two-dot chain line, respectively.

In such a structure, by the flow of oil-containing gas introduced from communication hole 22 into separation chamber 21 at most gas release side, an air curtain function is given against the flows of oil-containing gas introduced from the other communication holes 23, 24 into separation chamber 21 toward gas release side, and the oil-containing gas introduced from the other communication holes 23, 24 into separation chamber 21 efficiently rotates along the inner wall of separation chamber 21 without being pulled toward the gas release side, and can be separated into oil and gas. Therefore, an oil separation ability equal to or higher than that in a conventional oil separator having a separation pipe can be exhibited. Further, by setting the opening directions of the other communication holes 23, 24 to separation chamber 21 toward more oil storing chamber side than the opening direction of communication hole 22, the separated oil can be efficiently introduced into the oil storing chamber side.

INDUSTRIAL APPLICATIONS OF THE INVENTION

The structure of the compressor incorporated with an oil separator according to the present invention can be applied to any type compressor incorporated with an oil separator, and in particular, it is suitable to a scroll-type compressor.

The invention claimed is:

1. A compressor incorporated with an oil separator having a separation chamber, which is placed adjacent to a discharge chamber, has a space formed in the entire inside of said separation chamber, separates oil-containing gas being introduced into gas and oil by centrifugal separation, allows the separated oil to drop downward, and upwardly extracts the separated gas, and having communication holes provided between said discharge chamber and said separation chamber, which introduce the oil-containing gas, coming from said discharge chamber, into said separation chamber, wherein a plurality of said communication holes are arranged in a direction extending from a gas release side to an oil drop side, relative to said separation chamber.

2. The compressor incorporated with an oil separator according to claim 1, wherein a communication hole positioned at most gas release side among said plurality of communication holes is formed as a communication hole capable of giving a flow of oil-containing gas introduced from said communication hole into said separation chamber an air curtain function relative to a flow of oil-containing gas introduced from the other communication hole or communication holes into said separation chamber toward said gas release side.

3. The compressor incorporated with an oil separator according to claim 1, wherein said oil separator is formed by a joining structure of two compressor forming members.

4. The compressor incorporated with an oil separator according to claim 1, wherein said oil separator has said separation chamber, said plurality of communication holes and a lower hole introducing the oil separated in said separation chamber into an oil-storing chamber positioned below said separation chamber.

5. The compressor incorporated with an oil separator according to claim 1, wherein a passageway for gas having passed through said separation chamber is provided between said separation chamber and a discharge port connected to outside of said compressor.

6. The compressor incorporated with an oil separator according to claim 1, wherein said separation chamber is formed in a cylindrical shape whose generating line extends straightly.

7. The compressor incorporated with an oil separator according to claim 1, wherein said separation chamber is formed in a cylindrical shape whose generating line extends curvedly.

8. The compressor incorporated with an oil separator according to claim 2, wherein an opening direction to said separation chamber of said communication hole positioned at most gas release side is set at a direction different from an opening direction or opening directions to said separation chamber of the other communication hole or communication holes.

9. The compressor incorporated with an oil separator according to claim 8, wherein said opening direction or opening directions to said separation chamber of the other communication hole or communication holes is or are directed to more oil-storing chamber side as compared with said communication hole positioned at most gas release side.

10. The compressor incorporated with an oil separator according to claim 5, wherein a stepped portion or a dam portion is provided in said passageway for gas having passed through said separation chamber.

11. The compressor incorporated with an oil separator according to claim 3, wherein said compressor is a scroll-type compressor, one of said two members is a fixed scroll forming member, and the other of said two members is a compressor casing.

* * * * *